US011724168B1

(12) United States Patent
Lefaivre

(10) Patent No.: US 11,724,168 B1
(45) Date of Patent: Aug. 15, 2023

(54) SKI SENSE

(71) Applicant: William Lefaivre, Taunton, MA (US)

(72) Inventor: William Lefaivre, Taunton, MA (US)

( * ) Notice: Subject to any disclaimer, the term of this patent is extended or adjusted under 35 U.S.C. 154(b) by 0 days.

(21) Appl. No.: 17/987,236

(22) Filed: Nov. 15, 2022

(51) Int. Cl.

| | |
|---|---|
| ***A63B 69/18*** | (2006.01) |
| ***A63C 11/00*** | (2006.01) |
| ***A63B 71/06*** | (2006.01) |
| ***A42B 3/30*** | (2006.01) |

(52) U.S. Cl.
CPC ..... *A63B 69/18* (2013.01); *A42B 3/30* (2013.01); *A63B 71/0622* (2013.01); *A63C 11/003* (2013.01); *A63B 2071/0655* (2013.01); *A63B 2071/0694* (2013.01); *A63B 2220/24* (2013.01); *A63B 2220/805* (2013.01); *A63B 2220/833* (2013.01); *A63B 2225/50* (2013.01); *A63B 2225/74* (2020.08)

(58) Field of Classification Search
CPC ..... G09B 19/0038; G09B 9/00; A63B 69/18; A63B 69/182; A63B 69/187; A63B 2069/185; A63C 2203/18; A63C 5/06; A63C 11/00; A63C 11/003
USPC ..... 434/253
See application file for complete search history.

(56) References Cited

U.S. PATENT DOCUMENTS 5,826,909 A * 10/1998 Brommer ..... A63C 11/00 280/809
2005/0050945 A1* 3/2005 Hrovath ..... A63C 11/003 73/65.09

FOREIGN PATENT DOCUMENTS

DE 102016210505 A1 * 3/2017
FR 3039890 A1 * 2/2017

OTHER PUBLICATIONS

"CARV: The world's most advanced ski wearable", https://getcarv.com/how-it-works, accessed May 19, 2023 (13 pages).

* cited by examiner

*Primary Examiner* — Robert J Utama
(74) *Attorney, Agent, or Firm* — Wilmer Cutler Pickering Hale and Dorr LLP

(57) ABSTRACT

An apparatus, system and method for ski training are disclosed herein for providing feedback to a skier regarding the orientation of their skis. The apparatus, system and method measure various distances between a first ski and a second ski, determine an angle between the first ski and the second ski based on information representative of various distances; and provide an indication of the measured angle.

20 Claims, 10 Drawing Sheets

SKI SENSE

TECHNICAL FIELD

Embodiments of the present disclosure relate to systems and methods for ski training.

BACKGROUND

Originally intended as a method to travel over snow, skiing has become a popular recreational winter sport. There are many different types of skiing such as downhill skiing, backcountry skiing, alpine touring, telemark skiing, cross-country skiing, etc.

Beginners often learn a technique of skiing called the "snowplow," which involves orienting the skis in a "V" configuration, such that the tips of the skis are closer together than the tail of the skis. The snowplow is also sometimes referred to as a "pizza" configuration because the skis roughly resemble a wedge-shaped slice of pizza, with the tips of the skis representing the "pointy forward end of a slice of pizza" and the length of the skis representing the edges of the slice.

More advanced skiers orient their skis such that the skis are parallel to one another while skiing down the slope. This configuration is sometimes referred to as "French fries" to distinguish it from the beginner snowplow/pizza configuration. Transitioning from a snowplow/pizza configuration to a parallel/French fry configuration generally increases speed of travel down the slope. Beginners and intermediate skiers often find it difficult to fully transition from snowplow/pizza to parallel/French fry. That is, rather than holding their skis parallel to one another for an extended period, such skiers tend to transition their skis rapidly between the two configurations. Another difficulty faced by beginners is learning to avoid a configuration of skis in which the distance between the tips of the skis is greater than the distance between the tails of the skis. FIG. 7B illustrates an exaggerated version of this configuration in which the distance 650 between the ski tips is significantly greater than the distance 654 between the tails. This configuration is unstable and can quickly lead to falling, or injury, even if the distance 650 between the ski tips is only slightly greater than the distance 654 between the ski tails.

Another challenge for beginner skiers is learning to avoid looking down at their skis and to instead look "down the slope" in the direction of their travel. It would therefore be advantageous to provide information to a skier regarding the orientation of his or her skis (e.g., whether they are parallel to one another or in a different configuration), without requiring the skier to look down at their feet.

SUMMARY

A system for providing feedback to skiers is disclosed. Skis are equipped with sensors for measuring distances between portions of the skis. The distance measurements provided by the sensors allow a processor to determine the orientation of the skis, e.g., the angle between the skis or whether the skis are parallel, where the angle between the skis can be considered as zero degrees if the skis are parallel to one another. Feedback regarding the orientation of the skis is provided to the skier. For example, indicators at the ski tips can glow green if the skis are parallel or nearly parallel. Further, those indicators can transition from glowing green to glowing yellow or red as the orientation of the skis transitions from parallel or nearly parallel to less desirable configurations. Other forms of feedback, e.g., from vibrating transducers, can also be provided to the skier.

BRIEF DESCRIPTION OF THE DRAWINGS

The objects and advantages will be apparent upon consideration of the following detailed description, taken in conjunction with the accompanying drawings, in which like reference characters refer to like parts throughout, and in which.

Figure 1:
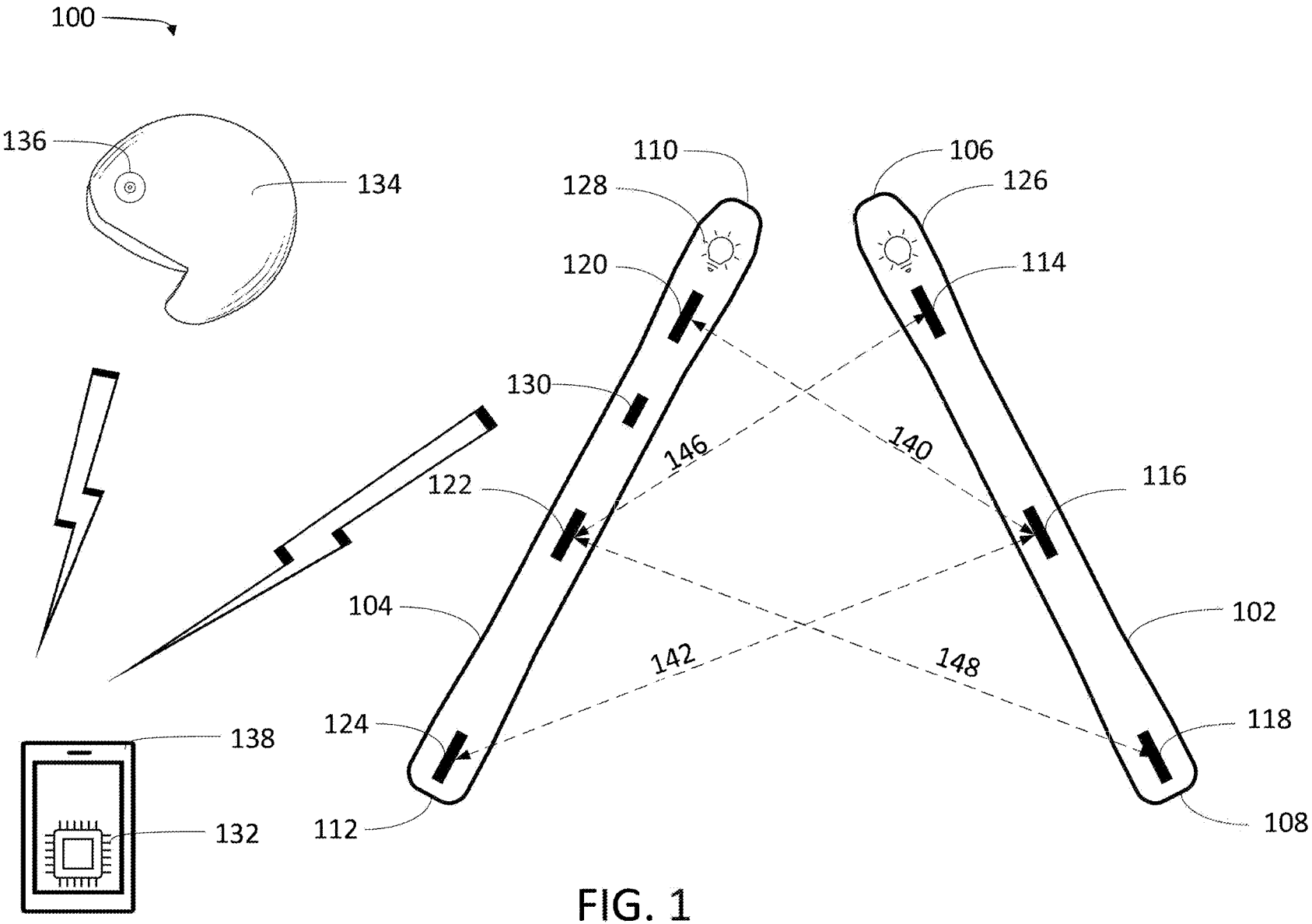
FIG. 1 shows a schematic of the ski training system, and top views of two skis, in accordance with some embodiments of the disclosure.

Various objectives, features, and advantages of the disclosed subject matter can be more fully appreciated with reference to the following detailed description of the disclosed subject matter when considered in connection with the above drawings, in which like reference numerals identify like elements.

DETAILED DESCRIPTION

An apparatus, system and method for indicating an orientation of skis, without requiring the skier to look down at their feet, is disclosed herein. In one aspect, the skis are equipped with sensors that provide distance measurements between parts of the skis. Those distance measurements provide sufficient information for determining whether the skis are parallel to one another. Further, if the two skis are not parallel, the distance measurements provide sufficient information for determining the angle between the two skis. The skis also have indicators, preferably disposed at the ski tips, for providing an indication of the orientation of the skis. For example, the indicators can be LEDs mounted at the ski tips and the indicators can (1) emit green light (or "glow green") when the angle between the skis is within a first range (e.g., indicative of ideal skiing), (2) emit yellow light (or "glow yellow") when the angle between the skis is within a second range (e.g., indicative of slightly dangerous or less ideal skiing), and (3) emit red light (or "glow red") when the angle between the skis is within a third range (e.g., indicative of more dangerous or even less desirable skiing). As an example, the indicators could (1) emit green light when the skis are parallel or within five degrees of parallel, (2) emit yellow light when the angle between the skis is between five and fifteen degrees, and (3) emit red light when the angle between the skis is negative (indicating that the ski tips are further apart than the ski tails) with an absolute value of greater than five degrees. The thresholds can of course be adjusted and may be adjustable, or settable, by the skier. Further, green, yellow and red light are merely exemplary forms of feedback that the indicators can provide, and persons skilled in the art will appreciate that other forms of feedback can be used.

A processor, or processing device, receives the distance measurements from the sensors and determines from those distance measurements the angle between the skis. In one embodiment, the processor is within the skier's mobile phone and an app running on the phone determines the angle between the skis. Alternatively, the processor can be in another device carried or worn by the skier. The processor can also be located on one of the skis. For embodiments in which the processor is not disposed on one of the skis (e.g., mobile phone embodiments), one of the skis also has a transceiver for wirelessly transmitting the distance measurements made by the sensors to the processor.

Preferably, the processor communicates wirelessly with the indicators to instruct the indicators which type of light (e.g., green, yellow or red) to emit.

In addition to the indicators disposed at the ski tips, other types of indicators, such as a vibrating indicator, can also be included. For example, the skier's helmet can be equipped with a vibrating indicator that vibrates when the angle between the skis represents an undesirable skiing configuration. Such vibrating indicators can be advantageous because they provide feedback to the skier regarding the angle between the skis regardless of where the skier is looking. The processor (e.g., mobile phone) preferably communicates wirelessly with the vibrating indicator(s) to instruct the indicator(s) whether to vibrate and, if so, how intensely to vibrate.

The feedback provided to the skier (e.g., the color of light emitted by indicators disposed at the ski tips or vibration of a vibrating indicator) can be based on instantaneous measurements of the angle between the skis. Alternatively, it can be advantageous to base that feedback on time-averages of the measurements of the angle between the skis. For example, a time-average system could change the light emitted by the indicators from green to yellow if the average of the angle between the skis as measured over a three-second period is above a threshold. Using such time averaging can be advantageous to avoid providing the skier with feedback that changes too rapidly. It will be appreciated that other periods, e.g., half of a second or a quarter of a second, could also be used for the averaging.

The sensors disposed on the skis can be implemented using any form of proximity sensor, distance sensor, or detector. As those of ordinary skill will appreciate, the sensors can be implemented, e.g., using light-based sensors, electromagnetic wave-based sensors, magnetic sensors, capacitive sensors, or any other type of sensor that can measure the distance between two points. For example, infrared sensors emit infrared light, and determine the distance between the emitter and a reflective object. Such sensors have a small form factor and a relatively low cost. As another example, LiDAR sensors measure the distance between an emitter and a reflective object by emitting pulsed light waves (e.g., a laser) instead of radio or sound waves. LiDAR sensors have a high measuring distance (e.g., up to 10 meters), but are more expensive than infrared sensors. As another example, magnetic sensors provide a sensing range (e.g., up to 120 millimeters) that can reliably detect magnetic objects, and the sensing range can be further increased if the object has a strong magnetism. Those skilled in the art will appreciate the tradeoffs between various types of sensors. Any appropriate form of sensor that can measure the distance between two points can be used with the embodiments disclosed herein.

FIG. 1 shows a schematic view of a ski training system 100, in accordance with some embodiments of the disclosure. Ski training system 100 includes a first ski (or "right" ski) 102 and a second ski (or "left" ski) 104 and FIG. 1 shows a top view of those skis. First ski 102 includes a tip 106 and a tail 108. Similarly, second ski 104 includes a tip 110 and a tail 112. The skis 102 and 104 also include sensors 114, 116, 118, 120, 122 and 124, and indicators 126 and 128, and one of the skis includes a transceiver 130. The sensors, indicators and transceiver can be attached to conventional skis or alternatively may be fabricated as part of the skis themselves.

A first ski tip sensor 114 is disposed proximal to the tip 106 of the first ski 102, a first ski tail sensor 118 is disposed proximal to the tail 108 of the first ski 102, and a first ski intermediate sensor 116 is disposed on the first ski 102 between the first ski tip sensor 114 and the first ski tail sensor 118. The first ski indicator 126 is disposed on the first ski 102 proximal to the tip 106 of the first ski 102.

A second ski tip sensor 120 is disposed proximal to the tip 110 of the second ski 104, a second ski tail sensor 124 is disposed proximal to the tail 112 of the second ski 104, and a second ski intermediate sensor 122 is disposed on the second ski 104 between the second ski tip sensor 120 and the second ski tail sensor 124. The second ski indicator 128 is disposed on the second ski 104 proximal to the tip 110 of the second ski 104. A transceiver 130 is disposed on the second ski 104.

As illustrated, the indicators 126, 128 are preferably disposed at or near the ski tips 106, 110, respectively. This allows the skier to receive (or "see") feedback provided by the indicators without looking down at their feet. Rather, merely by glancing at the ski tips, the skier can receive the feedback provided by the indicators 126, 128.

Figure 2:
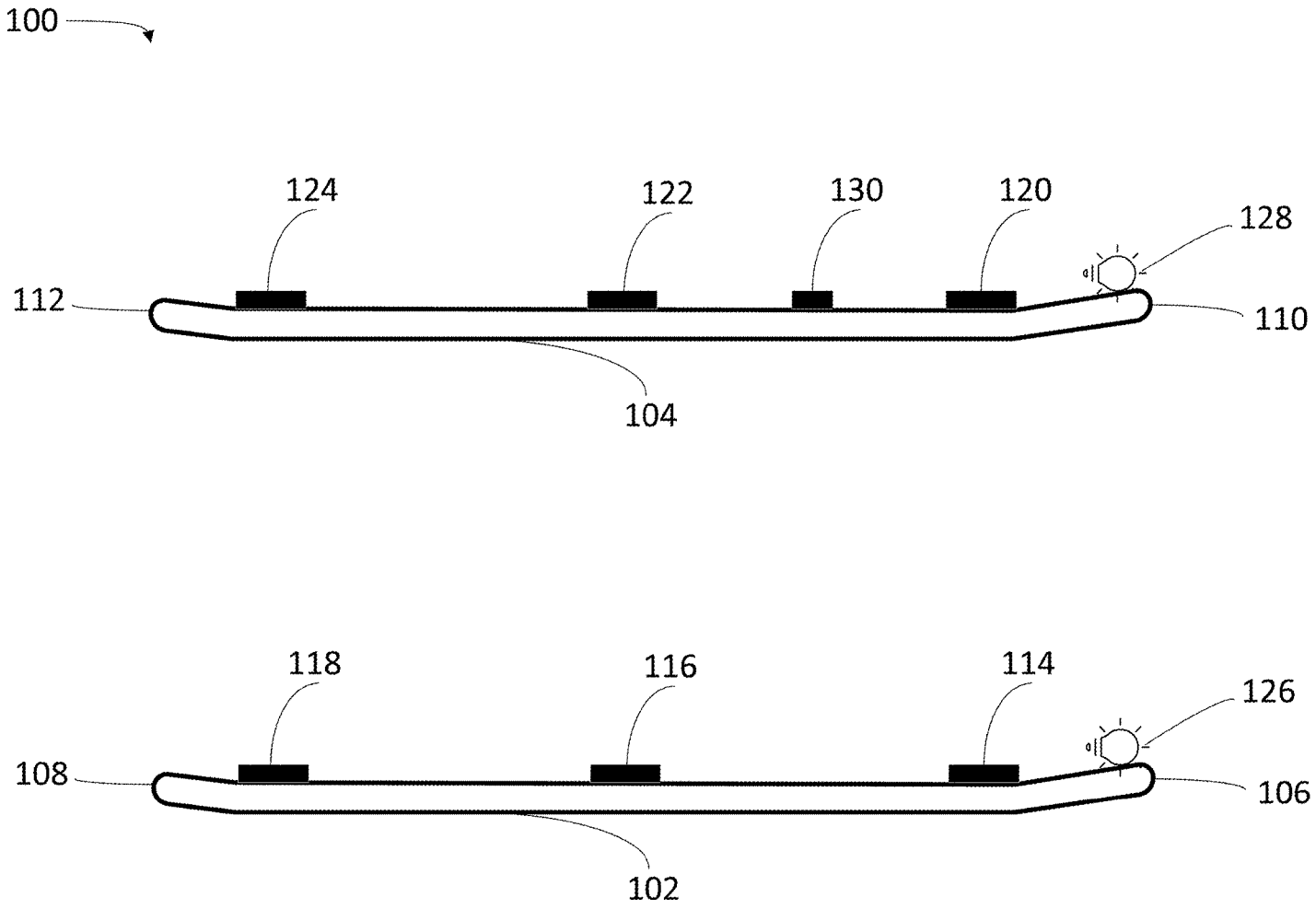
FIG. 2 shows a side view the skis shown in FIG. 1.

FIG. 2 shows a side view of skis 102, 104. As shown in FIG. 2, the first ski tip sensor 114, the first ski intermediate sensor 116, the first ski tail sensor 118, and the first ski indicator 126 are disposed on a top surface of the first ski 102. Similarly, the second ski tip sensor 120, the second ski intermediate sensor 122, the second ski tail sensor 124, the second ski indicator 128, and the transceiver 130 are disposed on a top surface of the second ski 104.

At least one of the first ski tip sensor 114, the first ski intermediate sensor 116, the first ski tail sensor 118, the second ski tip sensor 120, the second ski intermediate sensor 122, and the second ski tail sensor 124 measure distances between that sensor and some or all of the other sensors. Alternatively, distances between locations on the same ski, or intra-ski distances (e.g., the distance between first ski tip sensor 114 and first ski intermediate sensor 116) can be premeasured and stored, e.g., in a read only memory (ROM) or a random-access memory (RAM) or both. While intra-ski distances can change slightly during skiing, e.g., as a ski flexes, the change in such distances is negligible, or nearly negligible, as compared with changes in inter-ski distances, i.e., distances between points on different skis. Accordingly, the sensors may measure only inter-ski distances and the system 100 may use premeasured/prestored values for intra-ski distances.

Referring again to FIG. 1, in some embodiments, the first ski intermediate sensor 116 measures a distance 140 between it and the second ski tip sensor 120, and a distance 142 between it and the second ski tail sensor 124. Similarly, the second ski intermediate sensor 122 measures a distance 146 between it and the first ski tip sensor 114, and a distance 148 between it and the first ski tail sensor 118.

Transceiver 130 transmits information indicative of the measured distances to a processor 132, and the processor 132 uses the information to determine an angle between the first ski 102 and the second ski 104. In some embodiments, the processor 132 uses some or all of the distances 140, 142, 146 and 148 to determine the angle between the first ski 102 and the second ski 104. For example, the processor 132 determines the angle based on mathematical, e.g., trigonometric, analysis.

Figure 3A:
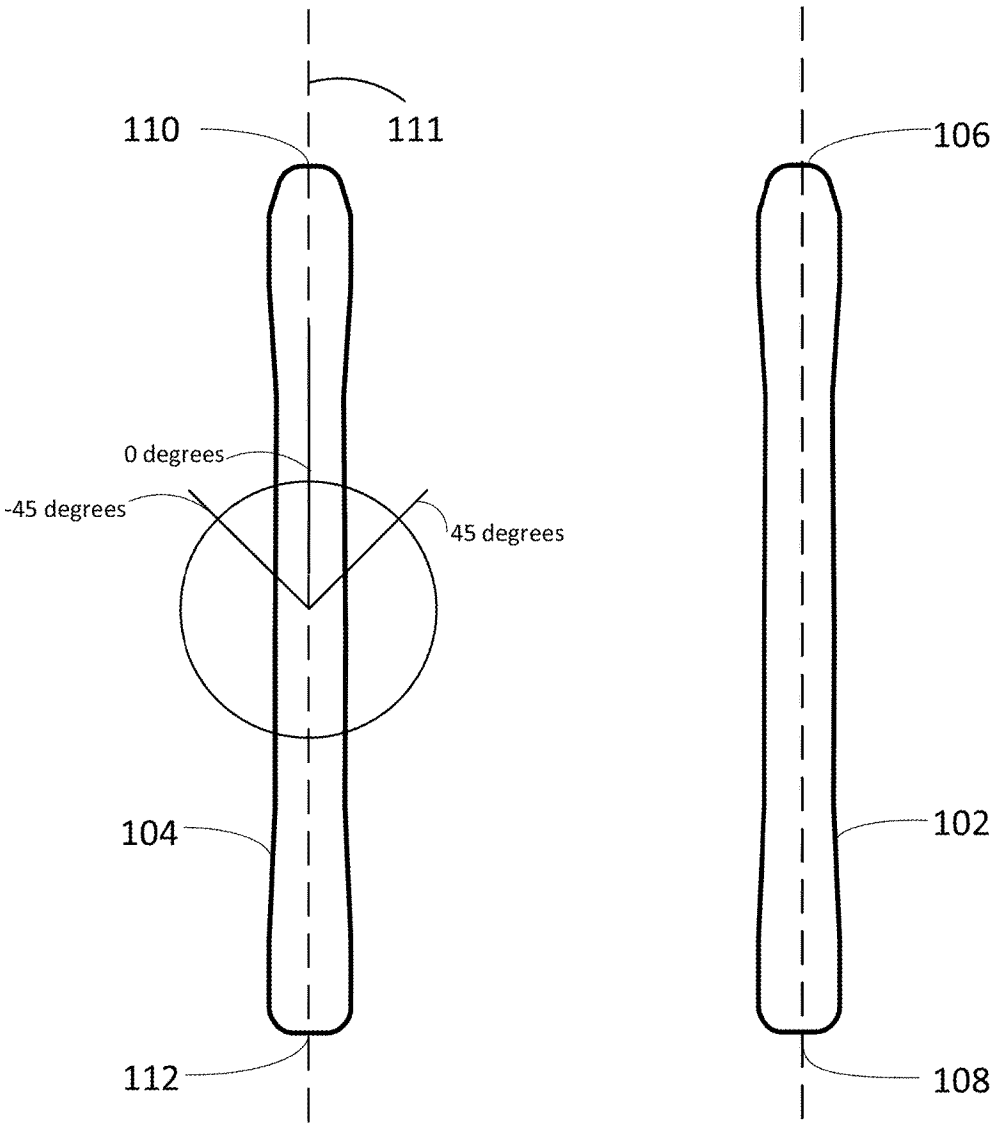
FIGS. 3A-3C show a reference frame for measuring an angle between the skis.
Figure 3B:
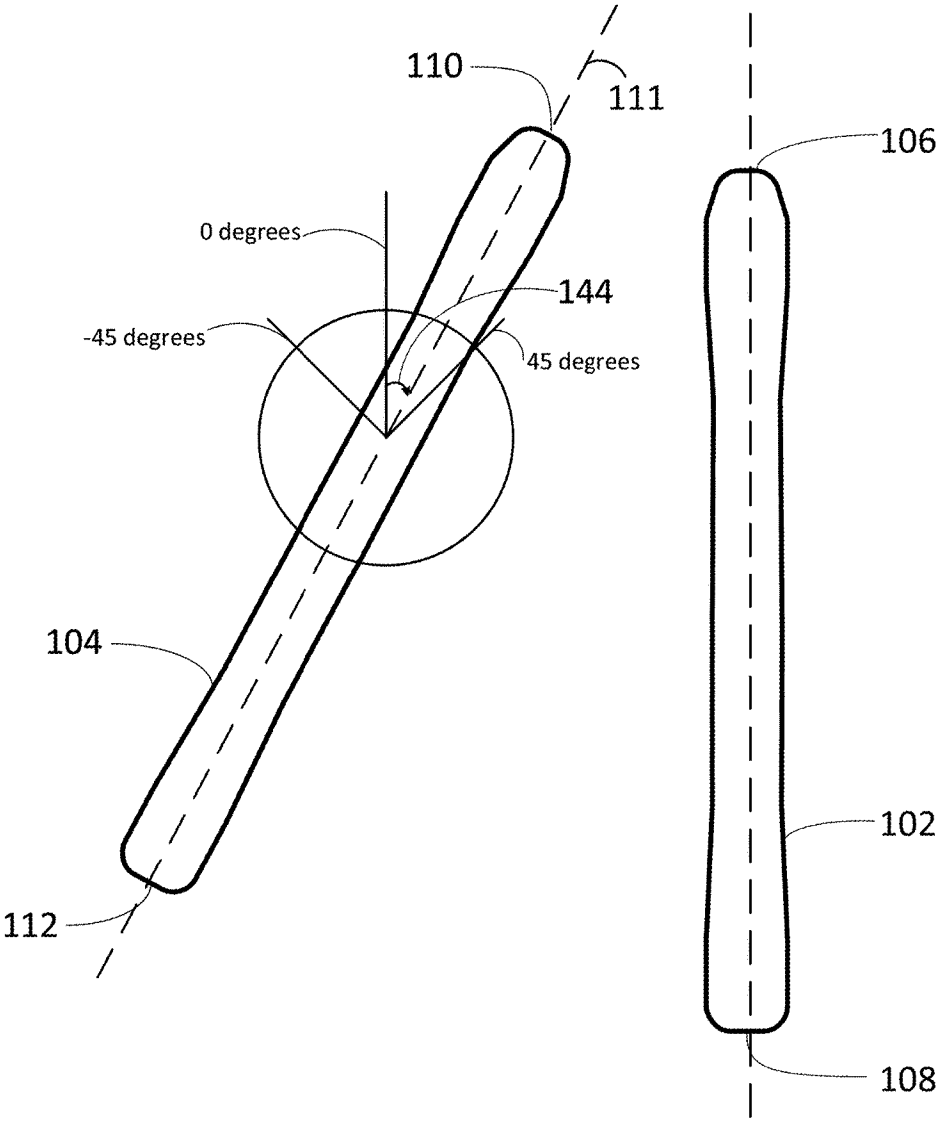
Figure 3C:
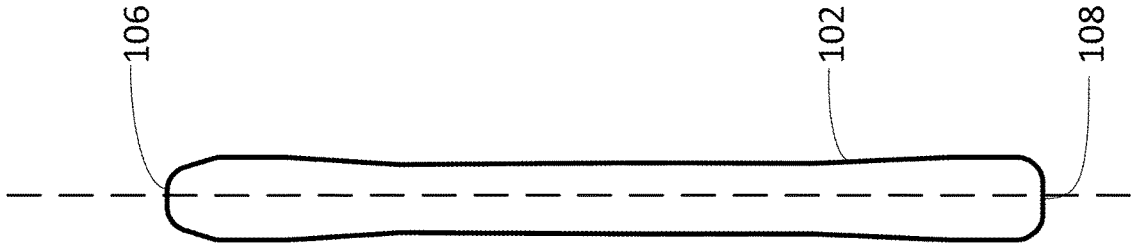
Figure 3C:
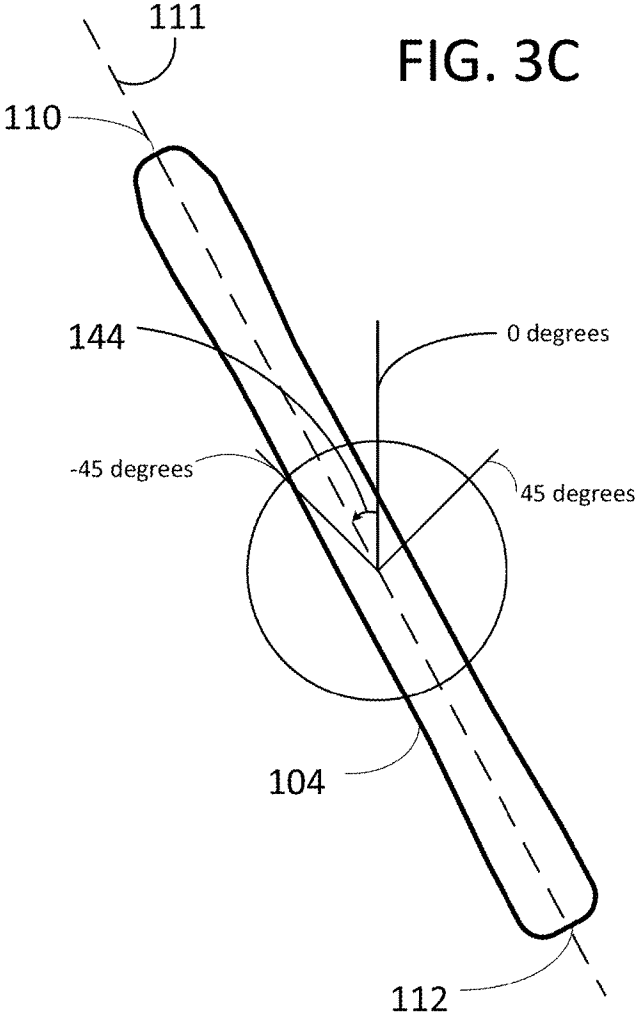

FIGS. 3A-3C describe a reference frame for measuring an angle 144 between the first ski 102 and the second ski 104. In FIG. 3A, the skis are parallel such that the angle between the skis is zero degrees. In FIG. 3B, the angle 144 between the skis is approximately 30 degrees. In FIG. 3C, the angle 144 between the skis is approximately minus 30 degrees. As shown in FIGS. 3A-3C, the right ski 102 can be used as a reference and can be assumed to be oriented at zero degrees. The left ski 104 can then be referenced to a 360-degree circle such that the angle between the skis equals the angle between the left ski (or a longitudinal axis of the left ski 111) and a zero-degree line that is parallel to the right ski (i.e., angle 144).

While the system illustrated in FIGS. 3A-3C can be used to measure any angle between the skis, practically there is little need for providing feedback to the skier beyond a range of minus 45 degrees to 45 degrees. For example, an angle of 180 degrees would represent the skis being parallel, but the tip of one ski being proximal to the tail of the other and such a configuration is extremely unlikely to occur, especially for beginning skiers. Alternatively, for purposes of providing feedback to the skier, an angle of 180 degrees between the skis can simply be treated as an angle greater than 45 degrees, or some other threshold. Those of ordinary skill will appreciate that reference frames other than the one illustrated in FIGS. 3A-3C can be used for measuring the angle between the skis. Further, using a convention of negative angles corresponding to tips of skis being further apart than tails and positive angles corresponding to tips of skis being closer together than tails is merely a matter of convenience.

Also, while the systems disclosed herein can measure the orientation of the skis with respect to one another in 3-dimensional space, doing so is generally unnecessary. That is, when a skier is skiing, the two skis are generally both in contact with the ground. As such, the skis can be presumed to lie in or close to a two-dimensional plane (defined by the ground, or the top surface of the snow). Therefore, while it possible to measure, and provide feedback to the skier, regarding the 3-dimensional orientation of one ski relative to another, it is often preferable to presume the skis lie in the same plane and to merely provide feedback to the skier regarding the angle between the skis, e.g., as illustrated in FIGS. 3A-3C.

Returning to FIG. 1, the processor 132 can be contained within a device such as a device 138, such as a mobile phone, and an application running on the device 138 can compute the angle between the skis based on the information received from the sensors. The processor 132 or device 138 communicates wirelessly with indicators 126 and 128, instructing them which type of light to emit based on the angle measured between the skis.

Optionally, the ski training system 100 further includes a third indicator 136 disposed in a helmet 134. In some embodiments, the third indicator 136 is a vibration transducer. The processor 132 or device 138 controls the third indicator 136, e.g., by instructing the indicator 136 whether to vibrate and, if so, how intensely to vibrate, based on the angle 144 between the skis. For example, indicator 136 may not vibrate at all if the skis are parallel or nearly parallel (e.g., within plus or minus 5 degrees). Further, the indicator 136 may begin vibrating as the skis deviate from parallel or substantially parallel to substantially non-parallel and the intensity of the vibration can increase as the absolute value of the angle between the skis increases. Additional vibrating sensors can also be included.

In some embodiments, the first ski intermediate sensor 116 and the second ski intermediate sensor 122 can be "emitters" or "active sensors," e.g., devices that emit infrared light for an infrared sensor. Similarly, the first ski tip sensor 114, the first ski tail sensor 118, the second ski tip sensor 120, and the second ski tail sensor 124 can be "reflectors" or "passive sensors." The active sensors emit signals (e.g., electromagnetic wave, laser) to the passive sensor(s), and receives reflections, or signals that have bounced back from the passive sensor(s). However, this arrangement of active sensors and passive sensors is for illustrative purpose only, and various combinations of active and passive sensors can be used. In some embodiments, the passive sensor is selected based on the type of active sensor that is used. For example, if a magnetic sensor is used as an active sensor, then the passive sensors may be chosen from ferromagnetic materials such as iron, cobalt and nickel, because magnetic sensors can sense ferromagnetic materials. As another example, if an infrared sensor is used as an active sensor, the corresponding passive sensor may be a reflector optimized for reflecting infrared light. Also, different types of active sensors can be used to reduce interference between the sensors. For example, if the first ski intermediate sensor 116 is a magnetic sensor, the second ski intermediate sensor 122 may be a light-based sensor, electromagnetic wave-based sensor, etc.

Referring still to FIG. 1, for embodiments in which first intermediate sensor 116 measures two distances 140 and 142, it may be preferable for sensor 116 to use two different techniques for measuring those distances. For example, if first intermediate sensor 116 is an infrared emitter, it may be desirable for it to emit two different frequencies of light. Further, reflector 120 may be optimized for reflecting one of the frequencies emitted by sensor 116 and reflector 124 may be optimized for reflecting the other frequency emitted by sensor 116. This would allow sensor 116 to measure both distances 140 and 142 without the reflectors 120 and 124 interfering with each other. Alternatively, sensor 116 may use one technique (e.g., infrared-based distance measurement) for measuring distance 140 and may use a different technique (e.g., magnetic-based distance measurement) for measuring distance 142. Those of ordinary skill will appreciate that any appropriate selection of sensors can be used as long as they provide measurements of the desired distances.

In some embodiments, the first ski indicator 126 and the second ski indicator 128 are color display modules. The color display module can contain a light source unit (not shown in FIG. 1 or FIG. 2) having a plurality of light emitting diodes (LEDs). Each of the LEDs is independently controlled to emit light, and each of the LEDs emits light of a specific color. For example, one LED can emit green light, one can emit yellow light, and one can emit red light. In some embodiments, the color display module displays a gradient color based on different input signals or voltage. For example, the color display module can display a gradual blending from green to yellow, and then to red as the orientation between the skis becomes less desirable. In some embodiments, the color display module displays different colors discretely.

Referring to FIGS. 1-2, the transceiver 130 disposed on the second ski 104 is for illustrative purpose only. The transceiver 130 may be disposed either on the first ski 102 or on the second ski 104, or one or more transceivers 130 may be disposed on both the first ski 102 and the second ski 104. The transceiver 130 communicates wirelessly with the processor 132, e.g., using communication technology such as WiFi, Bluetooth, Zigbee, or Insteon, Z-wave or the like. Alternatively, processor 132 and transceiver 130 may communicate via wired connections such as USB 2.0, USB 3.0, or other forms of wired communication.

The processor 132 is shown in FIG. 1 as embedded in the device 138 for illustrative purpose only and any references herein to the processor can instead refer to the processing device and vice versa. The processor 132 may be embedded in any computational device providing a human user interface or machine communication interface such as a mobile phone, tablet or mobile computer. In some embodiments, the processor 132, or processing device 138, communicates with the first indicator 126 and the second indicator 128 through low power, short range wireless communication technology such as WiFi, Bluetooth, Zigbee, or Insteon, Z-wave or the like.

One or all of the sensors, indicators and transceivers mentioned above is self-powered with an internal rechargeable or primary battery, fuel cell, energy harvesting generator/recharger, crank or kinetic generator, wireless induction, solar cell, super capacitor, etc. In some embodiments, one or more power components (not shown) may supply power to those sensors, indicators and transceivers.

As described above, the sensors 114, 116, 118, 120, 122 and 124, and indicators 126 and 128, and the transceiver 130 may be fabricated as part of the skis themselves. Alternatively, the sensors, indicators and/or transceivers may be attached to conventional skis. As those skilled in the art will appreciate, if the sensors are attached to conventional skis, they should be positioned at known distances relative to the tips and/or tails of the skis such that measurements made by the sensors can be used to reliably estimate the angle between the skis. Further, references herein to a right ski or a left ski are merely for convenience of exposition and persons skilled in the art will appreciate that the first ski could be worn on a skier's right or left foot and similarly the second ski could be worn on either a skier's right or left foot.

Figure 4:
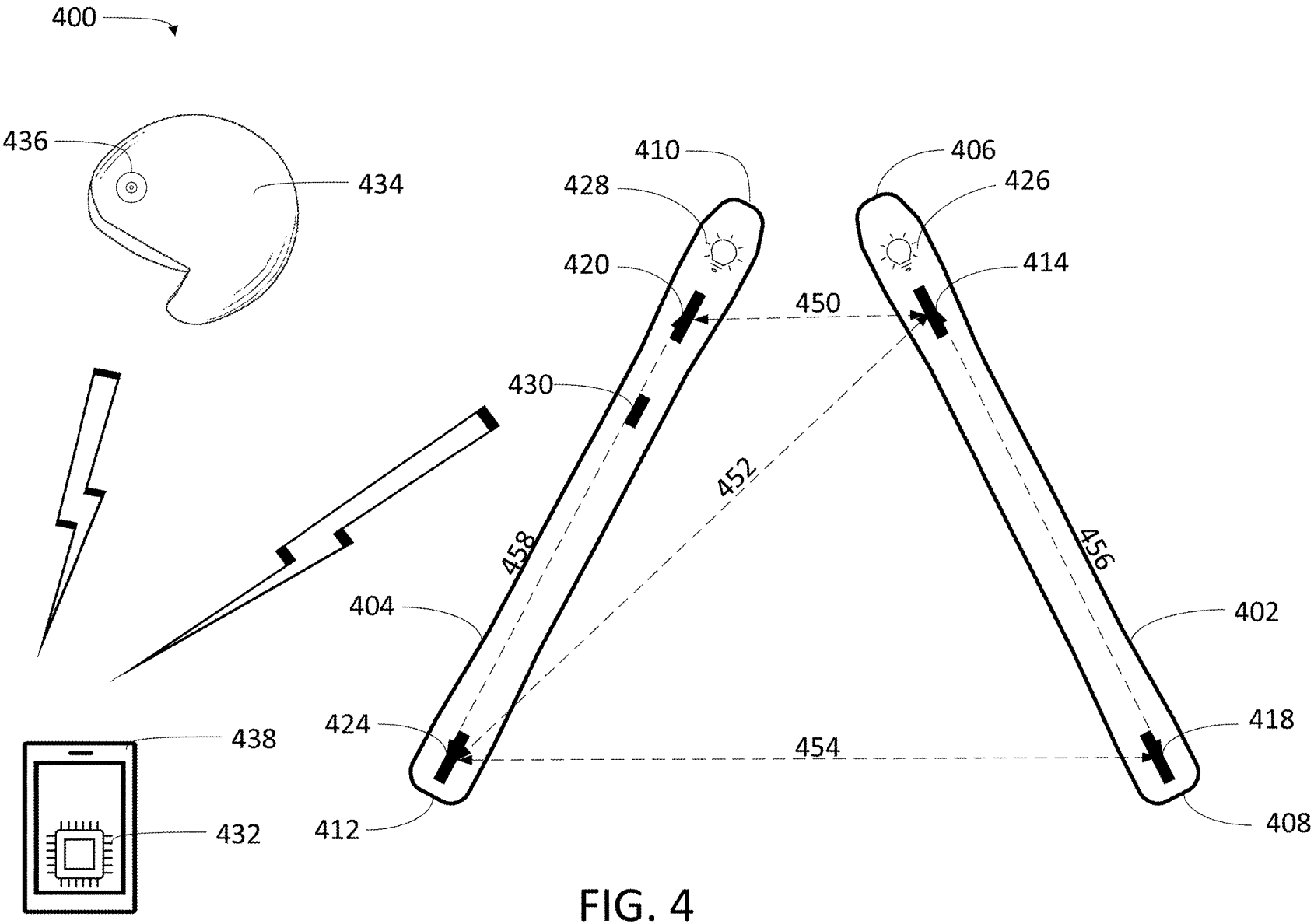
FIG. 4 shows a schematic of the ski training system, and top views of two skis, in accordance with some embodiments of the disclosure.
Figure 5:
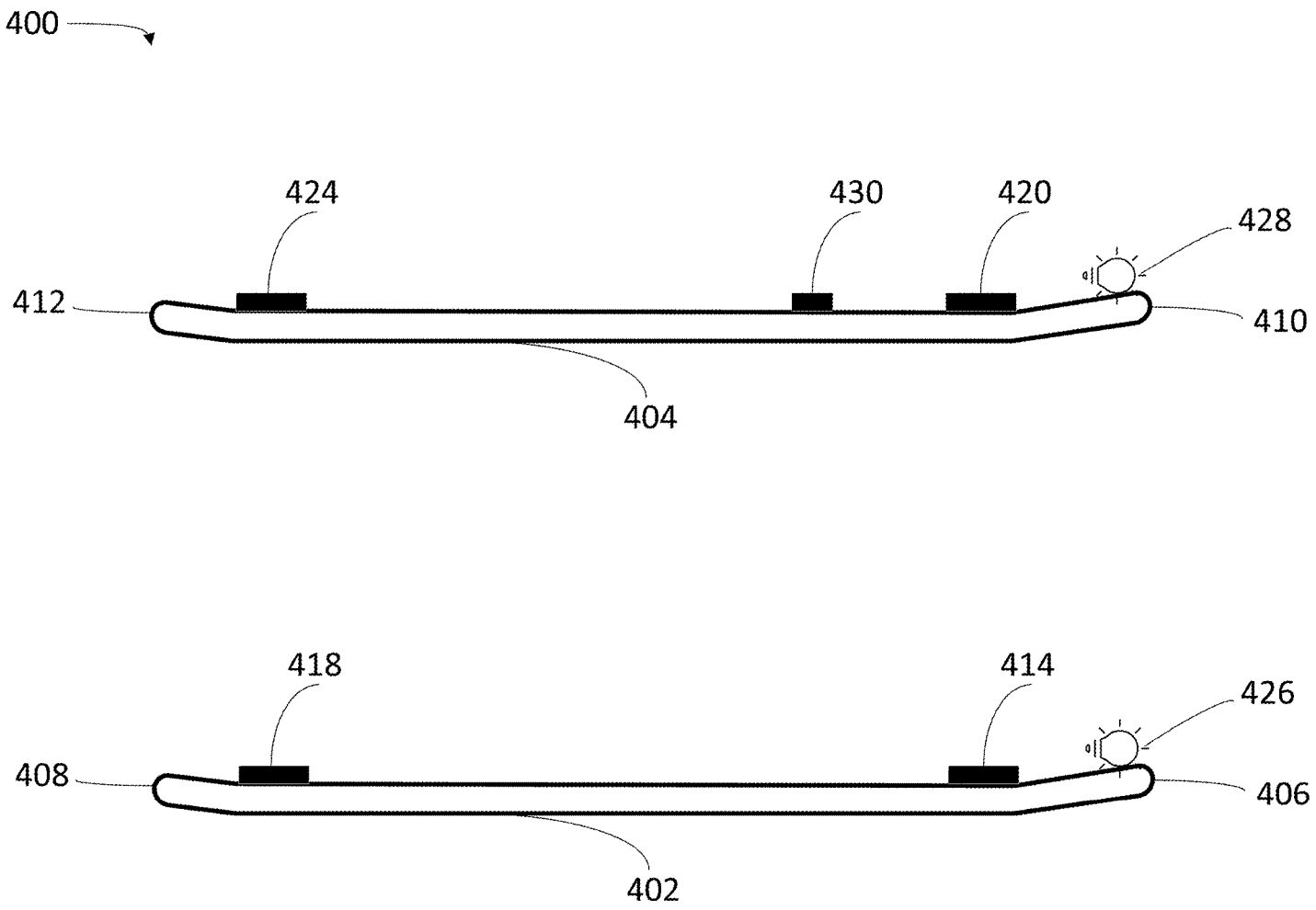
FIG. 5 shows a side view of the skis shown in FIG. 4.

FIG. 4 shows a schematic view of a ski training system 400 in accordance with some embodiments of the present disclosure. The ski training system 400 includes a first ski (or "right" ski) 402 and a second ski (or "left" ski) 404 and FIG. 4 shows a top view of those skis. FIG. 5 shows a side view of skis 402 and 404. A first ski tip sensor 414, a first ski tail sensor 418, a first ski indicator 426, a second ski tip sensor 420, a second ski tail sensor 424, a second indicator 428, a transceiver 430 and a processor 432 are disposed and function in a similar way as their corresponding counterparts as described in FIGS. 1-2. Optionally, referring again to FIG. 4, the ski training system 400 further includes a third indicator 436 disposed in a helmet 434, which function in a similar way as their corresponding counterparts as described in FIG. 1.

The first ski tip sensor 414 measures a distance 450 between it and the second ski tip sensor 420, and a distance 452 between it and the second ski tail sensor 424. The first ski tail sensor 418 measures a distance 454 between it and the second ski tail sensor 424. Alternatively, the second ski tail sensor 424 measures the distance 454 between it and the first ski tail sensor 418. Comparing FIG. 1 and FIG. 4, the system 100 in FIG. 1 measures four distances (140, 142, 146 and 148), whereas the system 400 in FIG. 4 measures only three distances (450, 452 and 454). Those of ordinary skill will appreciate that measuring only three distances, as shown in FIG. 4, is sufficient to determine the angle between the skis when the skis are assumed to be coplanar, i.e., within a plane defined by the ground, or surface of the snow. While measuring additional distances, e.g., as illustrated in FIG. 1, can increase the accuracy of the determination of the angle between the skis, doing so can also increase cost and complexity.

As with FIG. 1, the sensors can also measure intra-ski distances, such as the distance between first ski tip sensor 414 and first ski tail sensor 418, but such intra-ski distances can also be premeasured and stored, e.g., in a read only memory (ROM) or a random-access memory (RAM) or both.

Figure 6:
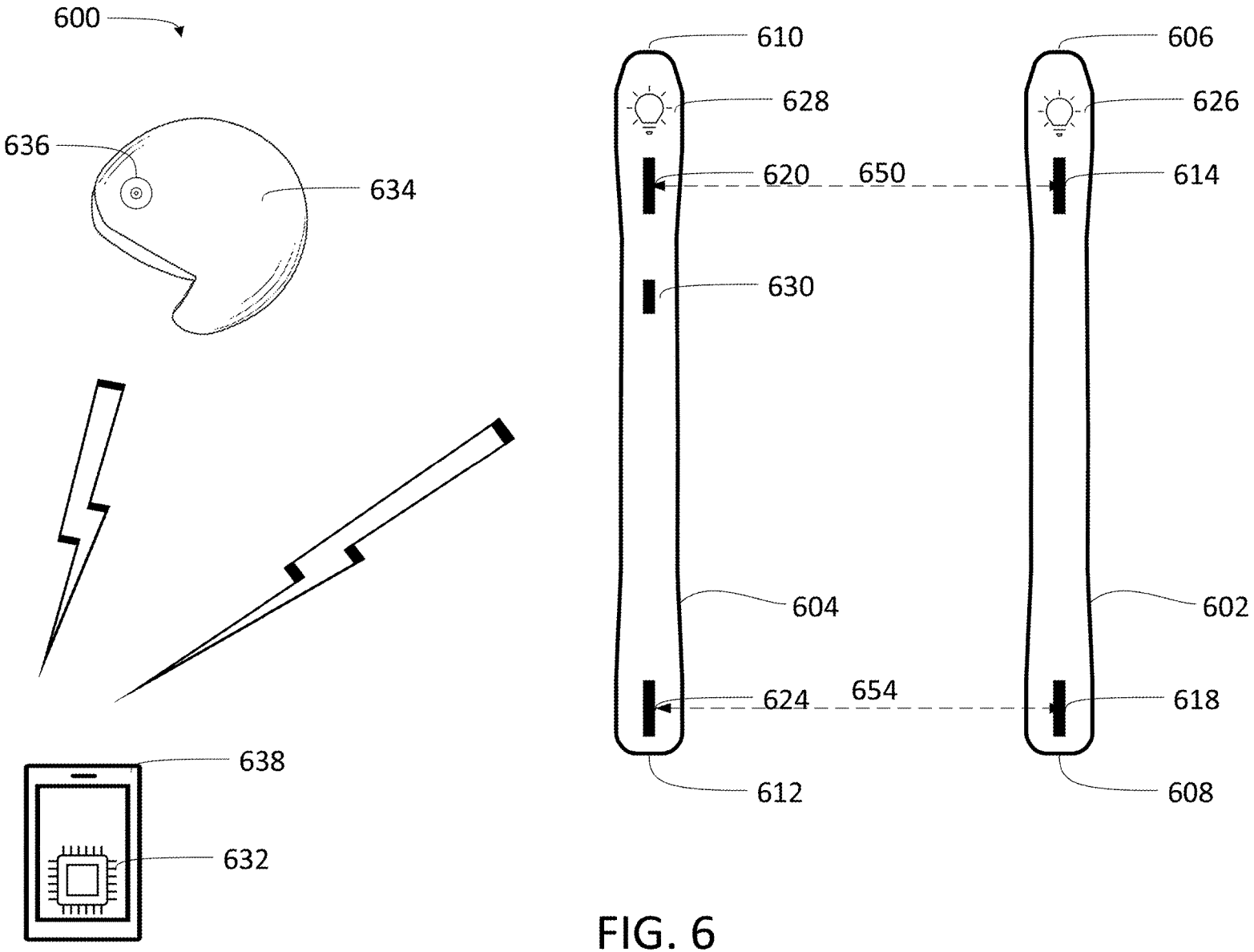
FIG. 6 shows a schematic of the ski training system, and top views of two skis, in accordance with some embodiments of the disclosure.

FIG. 6 shows a schematic view of a ski training system 600 in accordance with some embodiments of the present disclosure. The ski training system 600 includes a first ski (or "right" ski) 602 and a second ski (or "left" ski) 604 and FIG. 6 shows a top view of those skis. A first ski tip sensor 614, a first ski tail sensor 618, a first ski indicator 626, a second ski tip sensor 620, a second ski tail sensor 624, a second indicator 628, a transceiver 630 and a processor 632 are disposed and function in a similar way as their corresponding counterparts as described in FIG. 4. Optionally, the ski training system 600 further includes a third indicator 636 disposed in a helmet 634 and they function in a similar way as their corresponding counterparts as described in FIG. 4.

In some embodiments, the first ski tip sensor 614 measures a distance 650 between it and the second ski tip sensor 620, and the first ski tail sensor 618 measures a distance 654 between it and the second ski tail sensor 624. Alternatively, the second ski tail sensor 624 measures the distance 654 between it and the first ski tail sensor 618. Comparing FIG. 4 and FIG. 6, the system 400 in FIG. 4 measured three distances (450, 452 and 454), whereas the system 600 in FIG. 6 measures only two distances (650 and 654). While measuring only two distances reduces accuracy of the angle measurement, as compared with the system 400 in FIG. 4 which measures three distances, measuring only two distances still allows for computation of the angle between the skis with reasonable accuracy and also simplifies the system.

The processor 632 uses the distances 650 and 654 to determine the configuration of the first ski 602 and the second ski 604. For example, as shown in FIG. 6, if the processor 632 determines that the distance 650 is substantially equal to the distance 654, the processor 632 then determines that the first ski 602 and the second ski 604 are parallel or substantially parallel to each other. For that configuration, the processor 632 can instruct the indicators (e.g., the first indicator 626, the second indicator 628) to emit a first type of light (e.g., green). The processor 632 may also instruct the third indicator 636 (e.g., vibration transducer) not to vibrate.

If the processor 632 determines that the distance 650 is substantially less or greater than the distance 654, the processor 632 then determines that the angle between the skis is substantially above or below zero degrees and the skis are not parallel to each other. The processor 632 can then instruct the first indicator 626 and the second indicator 628 to emit yellow or red light. The processor 632 may also instruct the third indicator 636 (e.g., vibration transducer) to vibrate at a certain level. The difference between the distance 650 and the distance 654 that causes an alarm (e.g., vibrating sensor 634) or change in indication (e.g., changing indicators 626 and 628 from green to yellow) can of course be adjusted and may be adjustable, or settable, by the skier. Further, green, yellow, red light and vibration are merely exemplary forms of feedback that the indicators can provide, and persons skilled in the art will appreciate that other forms of feedback can be used.

Figure 7A:
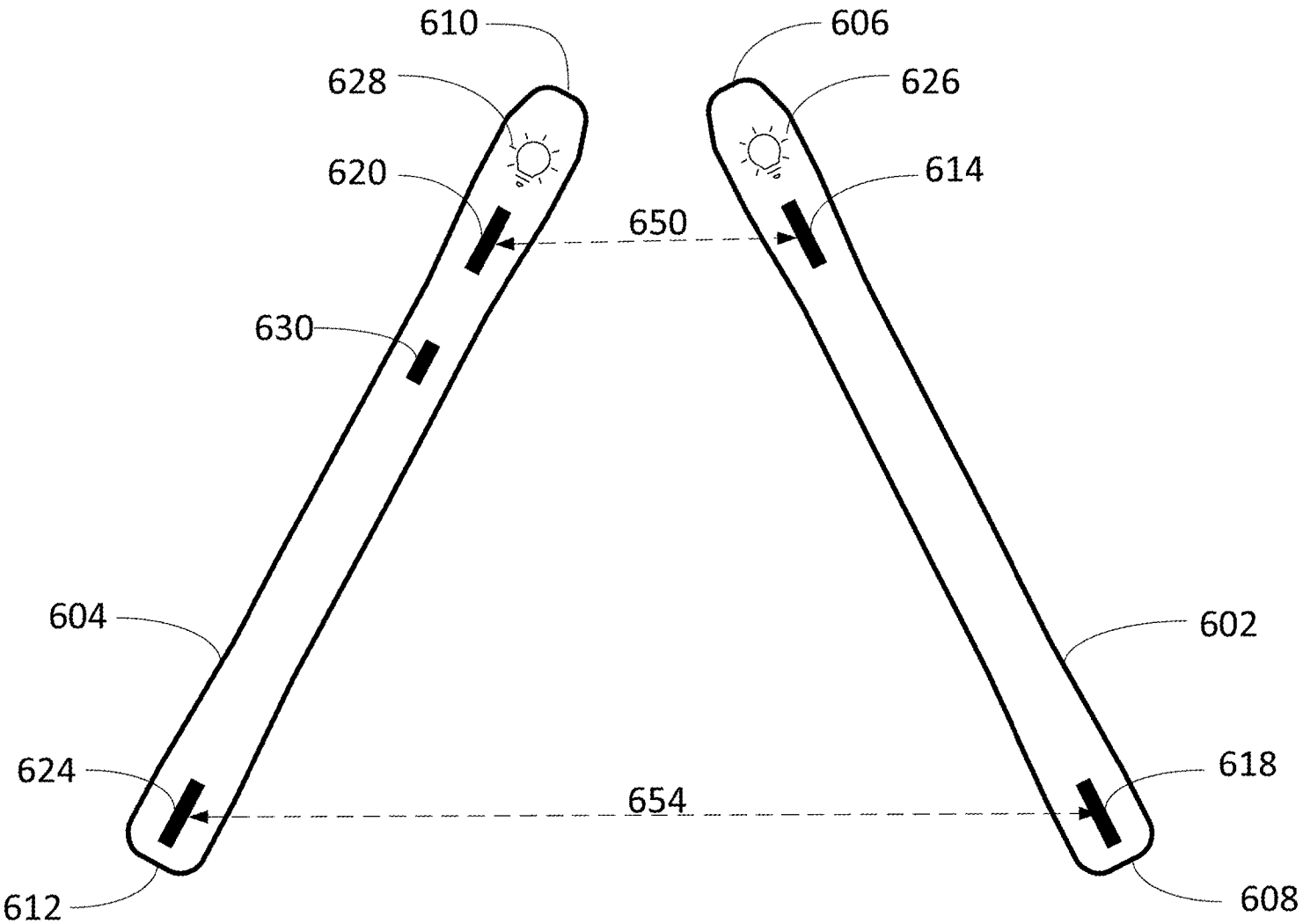
FIGS. 7A-7B show two skis of FIG. 6 in example configurations.
Figure 7B:
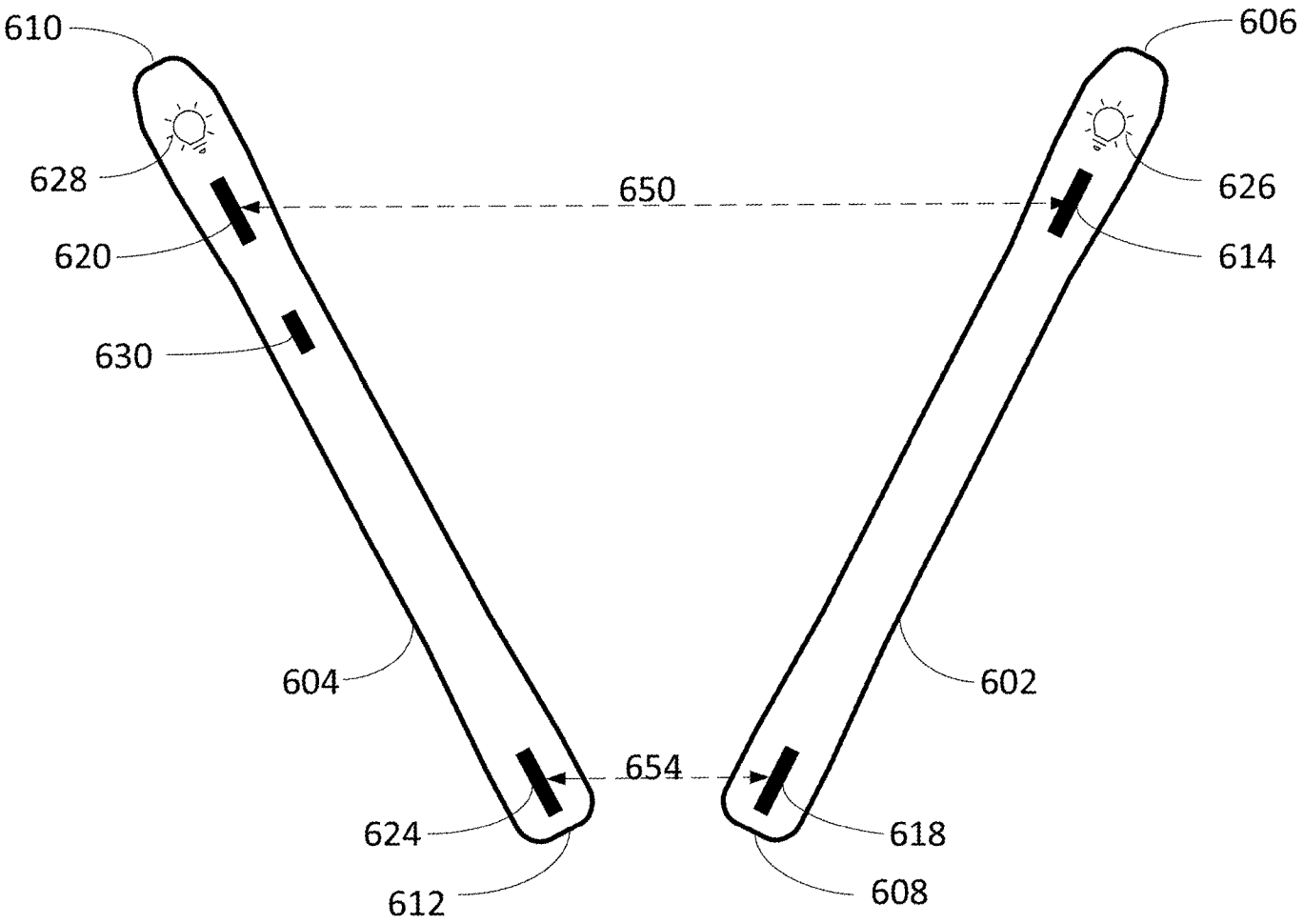

In some embodiments, as shown in FIG. 7A, if the distance 650 is substantially less than the distance 654, indicating that the skis are in the traditional snowplow configuration and the skier is relatively safe, the processor 632 can instruct the first indicator 626 and the second indicator 628 to emit yellow light, and can instruct the third indicator 636 to vibrate at a low level. As shown in FIG. 7B, if the distance 650 is greater than the distance 654, indicating that the skis are in abnormal configuration and the skier is about to fall, the processor 632 can instruct the first indicator 626 and the second indicator 628 to emit red light, and can instruct the third indicator 636 to vibrate at a high level to prompt the skier to adjust the orientation of the skis.

The subject matter described herein can be implemented in digital electronic circuitry, or in computer software, firmware, or hardware, including the structural means disclosed in this specification and structural equivalents thereof, or in combinations of them. The subject matter described herein can be implemented as one or more computer program products, such as one or more computer programs tangibly embodied in an information carrier (e.g., in a machine-readable storage device), or embodied in a propagated signal, for execution by, or to control the operation of, data processing apparatus (e.g., a programmable processor, a computer, or multiple computers). A computer program (also known as a program, software, software application, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file. A program can be stored in a portion of a file that holds other programs or data, in a single file dedicated to the program in question, or in multiple coordinated files (e.g., files that store one or more modules, sub programs, or portions of code). A computer program can be deployed to be executed on one computer or on multiple computers at one site or distributed across multiple sites and interconnected by a communication network.

The processes and logic flows described in this specification, including the method steps of the subject matter described herein, can be performed by one or more programmable processors executing one or more computer programs to perform functions of the subject matter described herein by operating on input data and generating output. The processes and logic flows can also be performed by, and apparatus of the subject matter described herein can be implemented as, special purpose logic circuitry, e.g., an FPGA (field programmable gate array) or an ASIC (application specific integrated circuit).

Processors suitable for the execution of a computer program include, by way of example, microprocessor, an embedded processor, a digital signal processor (DSP), a network processor, a handheld processor, an application processor, a co-processor, general and special purpose microprocessors, and any one or more processor of any kind of digital computers, and any one or more processor of any kind of digital computer. Generally, a processor will receive instructions and data from a read only memory or a random-access memory or both. The essential elements of a computer are a processor for executing instructions and one or more memory devices for storing instructions and data. The processor and the memory can be supplemented by, or incorporated in, special purpose logic circuitry.

It is to be understood that the disclosed subject matter is not limited in its application to the details of construction and to the arrangements of the components set forth in the following description or illustrated in the drawings. The disclosed subject matter is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the disclosed subject matter. It is important, therefore, that the claims be regarded as including such equivalent constructions insofar as they do not depart from the spirit and scope of the disclosed subject matter.

Although the disclosed subject matter has been described and illustrated in the foregoing exemplary embodiments, it is understood that the present disclosure has been made only by way of example, and that numerous changes in the details of implementation of the disclosed subject matter may be made without departing from the spirit and scope of the disclosed subject matter, which is limited only by the claims which follow.

What is claimed is:

1. A system comprising:

a first ski;

a first ski tip sensor, a first ski tail sensor, and a first ski intermediate sensor, the first ski tip sensor disposed proximal to a tip of the first ski, the first ski tail sensor disposed proximal to a tail of the first ski, the first ski intermediate sensor disposed on the first ski between the first ski tip sensor and first ski tail sensor;

a first ski indicator disposed on the first ski proximal to the tip of the first ski;

a second ski;

a second ski tip sensor, a second ski tail sensor, and a second ski intermediate sensor, the second ski tip sensor disposed proximal to a tip of the second ski, the second ski tail sensor disposed proximal to a tail of the second ski, the second ski intermediate sensor disposed on the second ski between the second ski tip sensor and second ski tail sensor;

a second ski indicator disposed on the second ski proximal to the tip of the second ski;

the first ski intermediate sensor measuring a first distance between the first ski intermediate sensor and the second ski tip sensor and a second distance between the first ski intermediate sensor and the second ski tail sensor;

the second ski intermediate sensor measuring a third distance between the second ski intermediate sensor and the first ski tip sensor and a fourth distance between the second ski intermediate sensor and the first ski tail sensor;

a processor;

a transceiver capable of transmitting information indicative of the first distance, the second distance, the third distance and the fourth distance to the processor; the processor using the information indicative of the first distance, the second distance, the third distance and the fourth distance to determine an angle between the first ski and the second ski, the processor controlling the first and second ski indicators based on the angle.

2. The system of claim 1, wherein at least one of the first ski intermediate sensor and the second ski intermediate sensor is a light detection sensor.

3. The system of claim 1, the transceiver wirelessly transmitting the information to the processor.

4. The system of claim 1, wherein at least one of the first ski indicator and the second ski indicator is a color display module, wherein the color display module comprises at least a light emitting diode (LED).

5. The system of claim 1, the processor controlling the first and second ski indicators to provide a first indication when the angle is within a first range, and to provide a second indication when the angle is within a second range.

6. The system of claim 5, the first indication comprising emitting green light and the second indication comprising emitting yellow light.

7. The system of claim 1, the processor controlling the first and second ski indicators to provide a first indication when the angle is within a first range, to provide a second indication when the angle is within a second range, and to provide a third indication when the angle is within a third range.

8. The system of claim 7, the first indication comprising emitting green light, the second indication comprising emitting yellow light, and the third indication comprising emitting red light.

9. The system of claim 1, further comprising:

a helmet; and a third ski indicator attached to the helmet, the processor further controlling the third ski indicator to vibrate based on the angle.

10. A system including:

a first ski;

a first sensor and a second sensor, the first and second sensors being disposed on the first ski, the first sensor being disposed closer to a tip of the first ski than the second sensor;

a first ski indicator disposed on the first ski proximal to the tip of the first ski;

a second ski;

a third sensor and a fourth sensor, the third and fourth sensors being disposed on the second ski, the third sensor being disposed closer to a tip of the second ski than the fourth sensor;

the first sensor measuring a first-third distance between the first and third sensors, the first sensor also measuring a first-fourth distance between the first and fourth sensors;

the second sensor or the fourth sensor measuring a second-fourth distance between the second and fourth sensors;

a processor; and a transceiver capable of transmitting information representative of the first-third distance, the first-fourth distance, and the second-fourth distance to the processor, the processor using the information representative of the first-third distance, the first-fourth distance, the second-fourth distance to determine an angle between the first ski and the second ski, the processor controlling the first indicator based on the angle.

11. The system of claim 10, the processor controlling the first ski indicator to provide a first indication when the angle is within a first range, and to provide a second indication when the angle is within a second range.

12. The system of claim 10, the processor controlling the first ski indicator to provide a first indication when the angle is within a first range, to provide a second indication when the angle is within a second range, and to provide a third indication when the angle is within a third range.

13. The system of claim 10, further comprising:

a helmet; and a third ski indicator attached to the helmet, the processor further controlling the third ski indicator to vibrate based on the angle.

14. A system including:

a first ski;

a first sensor and a second sensor, the first and second sensors being disposed on the first ski, the first sensor being disposed closer to a tip of the first ski than the second sensor;

a first ski indicator disposed on the first ski proximal to the tip of the first ski;

a second ski;

a third sensor and a fourth sensor, the third and fourth sensors being disposed on the second ski, the third sensor being disposed closer to a tip of the second ski than the fourth sensor;

the first sensor or the third sensor measuring a first-third distance between the first and third sensors;

the second sensor or the fourth sensor measuring a second-fourth distance between the second and fourth sensors;

a processor; and a transceiver transmitting information representative of the first-third distance and the second-fourth distance to the processor, the processor using the information representative of the first-third distance and the second-fourth distance to determine an angle between the first ski and the second ski, the processor controlling the first ski indicator based on the angle.

15. The system of claim 14, the processor controlling the first ski indicator to provide a first indication when the angle is within a first range, and to provide a second indication when the angle is within a second range.

16. The system of claim 15, wherein the first indication comprises emitting green light and the second indication comprises emitting yellow light.

17. The system of claim 14, the processor controlling the first ski indicator to provide a first indication when the angle is within a first range, to provide a second indication when the angle is within a second range, and to provide a third indication when the angle is within a third range.

18. The system of claim 17, wherein the first indication comprises emitting green light, the second indication comprises emitting yellow light and the third indication comprises emitting red light.

19. The system of claim 14, further comprising:

a helmet; and a third ski indicator attached to the helmet, the processor further controlling the third ski indicator to vibrate based on the angle.

20. The system of claim 1, wherein the first ski intermediate sensor is further configured to measure a fifth distance between the first ski intermediate sensor and the second ski intermediate sensor.

* * * * *